US006135063A

United States Patent [19]

Welden

[11] Patent Number: 6,135,063

[45] Date of Patent: Oct. 24, 2000

[54] DUAL REGULATOR DIRECT-FIRED STEAM GENERATOR

[76] Inventor: David P. Welden, N. Indiana Ave., Iowa Falls, Iowa 50126

[21] Appl. No.: 09/323,708

[22] Filed: Jun. 1, 1999

Related U.S. Application Data

[63] Continuation of application No. 09/266,381, Mar. 11, 1999.

[51] Int. Cl.[7] ..... F22D 7/00

[52] U.S. Cl. ..... 122/446; 431/12; 431/90

[58] Field of Search ..... 122/39, 40, 446, 122/5.52; 431/12, 90, 62, 89; 137/110, 114, 599

[56] References Cited

U.S. PATENT DOCUMENTS

| | | | |
|---|---|---|---|
| 2,654,995 | 10/1953 | Ostroff | 137/599 |
| 2,714,292 | 8/1955 | Strandwitz et al. | 137/599 |
| 3,741,710 | 6/1973 | Nelson | 431/90 |
| 3,797,989 | 3/1974 | Gordon | 431/90 |
| 3,905,394 | 9/1975 | Jerde | 137/599 |
| 4,118,172 | 10/1978 | Noir et al. | 431/12 |
| 4,614,491 | 9/1986 | Welden | 431/60 |
| 4,617,953 | 10/1986 | Kendall-Tobias | 137/110 |
| 4,644,967 | 2/1987 | Wyatt et al. | 137/599 |
| 5,158,108 | 10/1992 | Semaan et al. | 137/487.5 |
| 5,486,107 | 1/1996 | Bonne | 431/121 |
| 5,685,707 | 11/1997 | Ramsdell et al. | 431/90 |

*Primary Examiner*—Denise L. Ferensic
*Assistant Examiner*—Jiping Lu

[57] ABSTRACT

A direct-fired steam generator utilizes dual regulators for delivering combustible gas to a burner chamber. A first regulator is a constant pressure gas regulator. A second regulator is a variable pressure gas regulator. The variable pressure gas regulator utilizes a pressure feedback which is representative of the pressure in the burner chamber. One or more air blowers can be utilized to supply air (oxygen) to the burner chamber.

18 Claims, 3 Drawing Sheets

DUAL REGULATOR DIRECT-FIRED STEAM GENERATOR

CROSS-REFERENCE TO RELATED APPLICATIONS

This application is a Continuation Application of U.S. patent application Ser. No. 09/266,381, filed Mar. 11, 1999, entitled "Dual Regulator Direct-Fired Steam Generator," the disclosure of which, including appendices, is hereby incorporated by reference in its entirety.

STATEMENT REGARDING FEDERALLY SPONSORED RESEARCH OR DEVELOPMENT

Not Applicable.

BACKGROUND OF THE INVENTION

1. Field of the Invention

This invention relates generally to a boiler apparatus and specifically to a boiler apparatus utilizing dual gas pressure regulators with one regulator being a constant pressure gas regulator and the other regulator being a variable pressure gas regulator.

2. Description of the Related Art

In a direct fired steam generator, oxygen (air) and gas fuel are supplied to a burner chamber where the fuel is ignited. Water is likewise supplied to the burner chamber for conversion to steam. As opposed to a standard boiler mechanism wherein burnt combustion gases are exhausted through an output separate from the steam output, in a direct fired boiler, such burnt combustion gases are exhausted through the same output as the generated steam. Various direct fired boiler mechanisms are known in the prior art for producing the output of steam. These include U.S. Pat. Nos. 4,614,491; 5,368,474; 4,462,342; and 4,354,481 all issued to David P. Welden.

A common problem which exists in boilers of this type is the omission of carbon monoxide exhaust gases during the operation of the boiler. This problem occurs when the fuel/air mixture is too rich. A persistent problem in this field is the difficulty in designing a steam generator which can maintain a fuel/air mixture which is neither too lean nor too rich. This problem is particularly a concern when the steam generator is not operating at low pressures.

Gas pressure regulators can be used to help control the ratio. However, as the pressure in the burner chamber increases, the back pressure on the fuel line reduces the amount of fuel which is delivered to the burner. As a result the fuel/air mixture becomes too lean. Various variable gas pressure regulators have been used but these regulators are not without disadvantages. In practice, these regulators typically deliver a mixture which is too rich at the higher pressures and are exceedingly expensive.

Therefore, those concerned with these and other problems recognize the need for an improved system for delivering an appropriate fuel/air mixture to a burner chamber in a direct fired boiler system.

BRIEF SUMMARY OF THE INVENTION

This invention relates generally to a boiler apparatus and specifically to a boiler apparatus utilizing dual gas pressure regulators with one regulator being a constant pressure gas regulator and the other regulator being a variable pressure gas regulator. A direct-fired steam generator utilizes dual regulators for delivering combustible gas to a burner chamber. A first regulator is a constant pressure gas regulator. A second regulator is a variable pressure gas regulator. The variable pressure gas regulator utilizes a pressure feedback which is representative of the pressure in the burner chamber. One or more air blowers can be utilized to supply air (oxygen) to the burner chamber.

Therefore, an object of the present invention is the provision of an improved direct-fired steam generator.

Another object is to provide an improved direct-fired steam generator which simultaneously utilizes a constant pressure gas regulator and a variable pressure gas regulator.

A further object is to provide an improved direct-fired steam generator which reduces the emission of carbon monoxide during operation.

Other objects, advantages, and novel features of the present invention will become apparent from the following detailed description of the invention when considered in conjunction with the accompanying drawings.

DETAILED DESCRIPTION OF THE INVENTION

Figure 1:
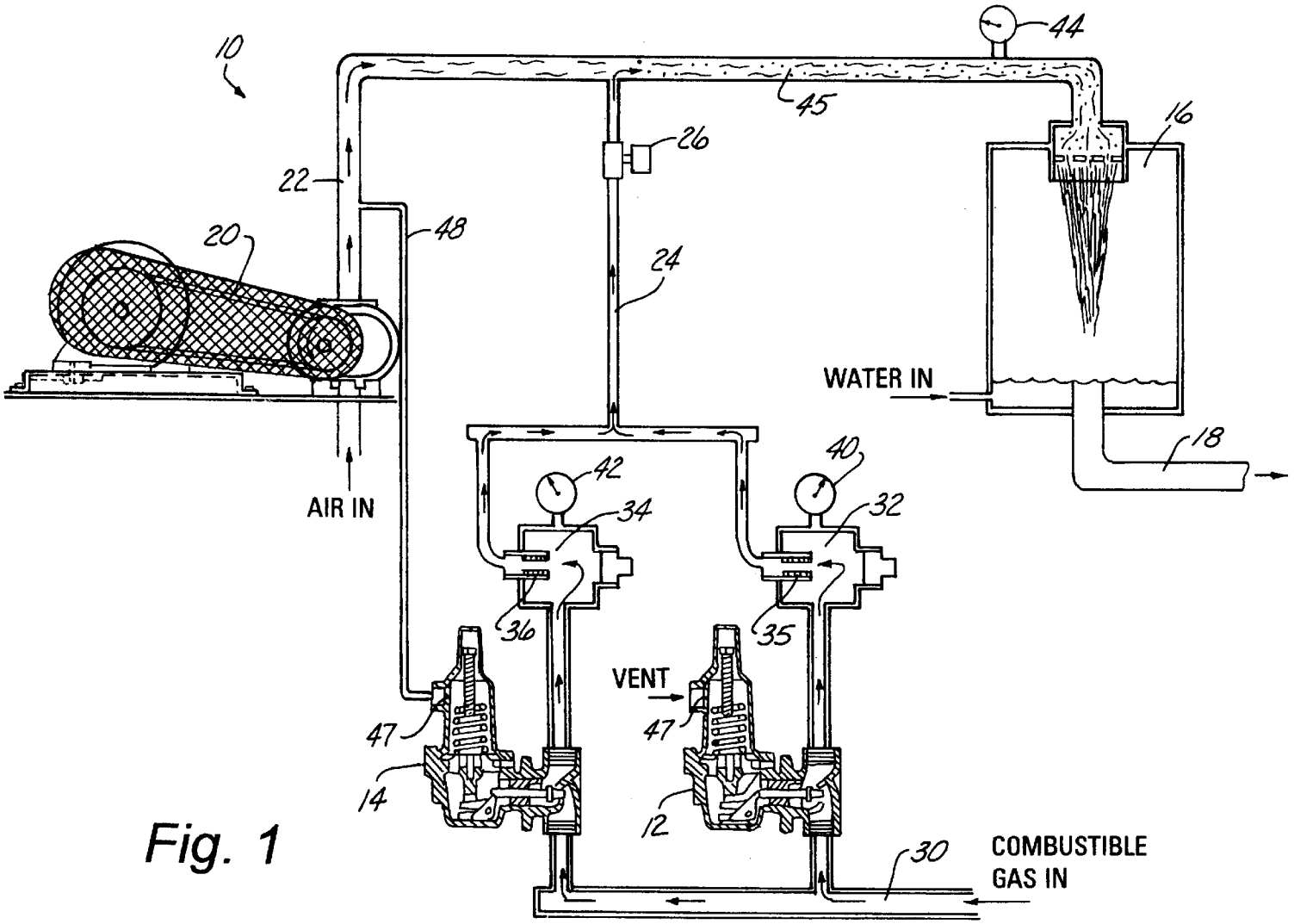
FIG. 1 is a schematic view of a dual regulator direct-fired steam generator built in accordance with the present invention.

Referring now to the drawings, wherein like reference numerals designate identical or corresponding parts throughout the several views, FIG. 1 shows a direct-fired steam generator (10) utilizing a constant pressure gas regulator (12) and a variable pressure gas regulator (14) built in accordance with the present invention. A burner chamber (16) receives fuel and air (oxygen) in sufficient quantities to support combustion. The burner chamber (16) also receives water for conversion into steam. The steam and burnt combustion gases are exhausted through an output (18). Only a simplified burner chamber (16) is shown in the present disclosure as various chambers are known in the prior art.

Air for the burner chamber (16) is provided by a blower (20) and is delivered to the burner chamber (16) via a conduit (22). Combustible gas is delivered to the burner chamber (16) via a conduit (24). A valve (26) prevents the delivery of gas when the system is not operational.

Combustible gas is provided to the system from a gas source via a conduit (30). Both the constant pressure gas regulator (12) and the variable pressure gas regulator (14) are connected to and receive gas via this conduit (30). Combustible gas exits both the constant pressure gas regulator (12) and the variable pressure gas regulator (14) and enters manifold (32) and manifold (34), respectively. The flow of combustible gas from the manifold (32) and the manifold (34) into the conduit (24) is restricted orifice (35) and orifice (36), respectively.

Pressure gauges can also be included at various positions to allow for the monitoring of pressures in the system (10). In the present embodiment, pressure gauge (40) is used to monitor the pressure in manifold (32). Pressure gauge (42)

is used to monitor the pressure in manifold (34). Pressure gauge (44) is used to monitor the air and fuel mixture (45) pressure in conduit (22).

Each gas pressure regulator (12 and 14) includes a vent (47). Regulators of this type are well known in the art and include the Model 627 Series Self-Operated Pressure Reducing Regulator manufactured by Fisher Controls. As is known, these devices are spring controlled. The spring is adjusted to increase and decrease the gas pressure flow through the regulator.

In the present invention, the constant pressure gas regulator (12) operates essentially as is known in the art. That is, with nothing connected to the vent (47). However, for the variable pressure gas regulator (14), the vent (47) is connected to the conduit (22) via conduit (48). In this embodiment of the present invention, the pressure inside conduit (22) is representative, i.e. approximately equal to, the pressure inside the burner chamber (16).

During operation, as the pressure in the burner chamber (16) increases, the back pressure communicated to regulator (14) via conduit (22) and conduit (48) likewise increase. This pressure enters the regulator (14) via the vent (47). The back pressure asserts a pressure inside the regulator which is in addition to the pressure being asserted by the spring. As a result, as the back pressure increases, the pressure level of gas permitted to flow through the regulator increases.

The simultaneous use of a variable pressure gas regulator (14), i.e. a regulator with a pressure feedback, and a constant pressure gas regulator (12) result in a performance superior to that of the use of either individually. When only a constant pressure gas regulator is use the fuel/air mixture becomes too lean as the pressure in the burner chamber rises. Additionally, when only a variable pressure gas regulator is used, the mixture becomes too rich as the pressure increases. Using a combination of the two balance the drawbacks of each prior solution and delivers a more consistent fuel/air ratio over a broader range of operational pressures. The regulators are set and the orifices are selected taking into consideration that it is the cumulative flow from both regulators which is delivered to the burner chamber.

Figure 2:
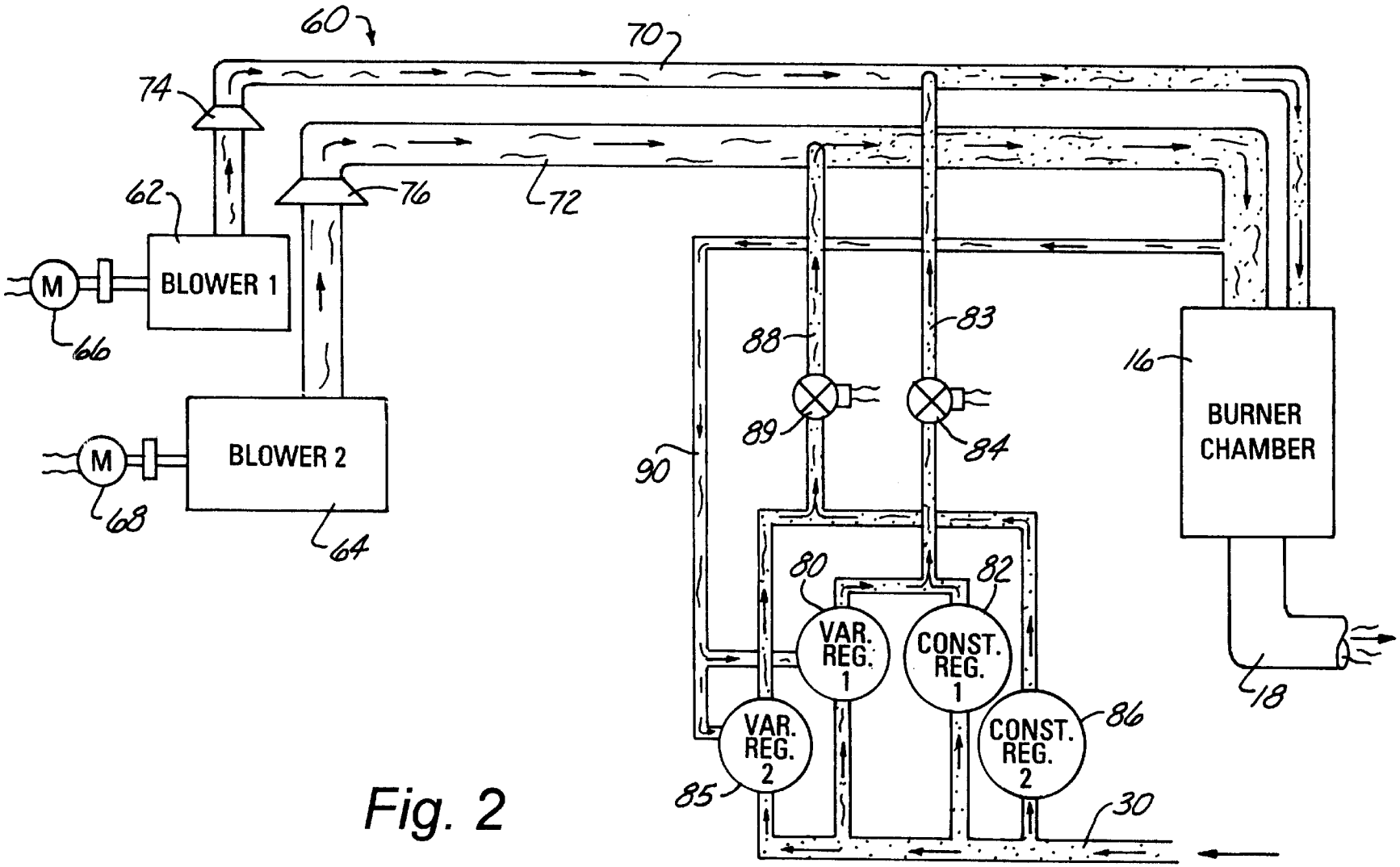
FIG. 2 is a schematic view of a dual regulator direct-fired steam generator built utilizing multiple stages and two blowers.

Referring now to FIG. 2, the present invention is implemented in a multi-stage steam generator system (60) which utilizes two blowers (62 and 64). In a preferred implementation of this embodiment, blower 2 (64) is approximately twice as large, i.e. has twice the capacity, of blower 1(62). Blower 1 (62) and blower 2 (64) are shown with accompanying motor (66) and motor (68), respectively. Blower construction is well known in the art.

With the two blowers (62 and 64) as shown, the system can operate in three stages not counting the state when the machine in nonoperational. Stage 1 is when only blower 1 (62) is operating. Stage 2 is when only blower 2 (64) is operating. Stage 3 is when both blower 1 (62) and blower 2 (64) are operating.

Apart from utilizing multiple stages for the blowers, the system (60) operates essentially the same as the system (10) described above. Air is delivered to the burner chamber (16) from blower 1 (62) via conduit (70). Air is delivered to the burner chamber (16) from blower 2 (64) via conduit (72). Conduit (70) includes a check valve (74) which prevents back pressure from reaching blower 1 (62) when blower 2 (64) is operating and blower 1 (62) is not operating. Similarly, conduit (72) includes a check valve (76) which prevents back pressure from reaching blower 2 (64) when blower 1 (62) is operating and blower 2 (64) is not operating.

Air from blower 1 (62) is mixed with fuel from a variable pressure gas regulator 1 (80) and a constant pressure gas regulator 1 (82) delivered via a conduit (83). A valve (84) permits gas to be delivered only when blower 1 (62) is operating. In the same manner, air from blower 2 (64) is mixed with fuel from a variable pressure gas regulator 2 (85) and a constant pressure gas regulator 2 (86) delivered via a conduit (88). A valve (89) permits gas to be delivered only when blower 2 (64) is operating. Gas is supplied to all of the regulators (80, 82, 85 and 86) via conduit (30). Back pressure is delivered to the variable pressure gas regulators (80 and 85) via conduit (90).

The connection of conduit (90) for delivering a back-pressure representative of the burner chamber (16) pressure should be addressed. There are a variety of points at which the connection can be made. These include connection to the burner chamber itself and also include any of the input conduits connected to the burner chamber (16). When connecting to the conduits connected to the burner chamber (16) it important connect the feedback on the burner chamber side of the check valve. While a connection on the blower side of the check valve can be made to work, it requires making a connection to the conduit for each blower and the addition of check valves in the feed back pressure line to prevent pressure leakage back to non-operating blowers. This scheme is considerably more complicated and therefore a preferred implementation includes one connection made on the burner chamber side of a check valve.

Figure 3:
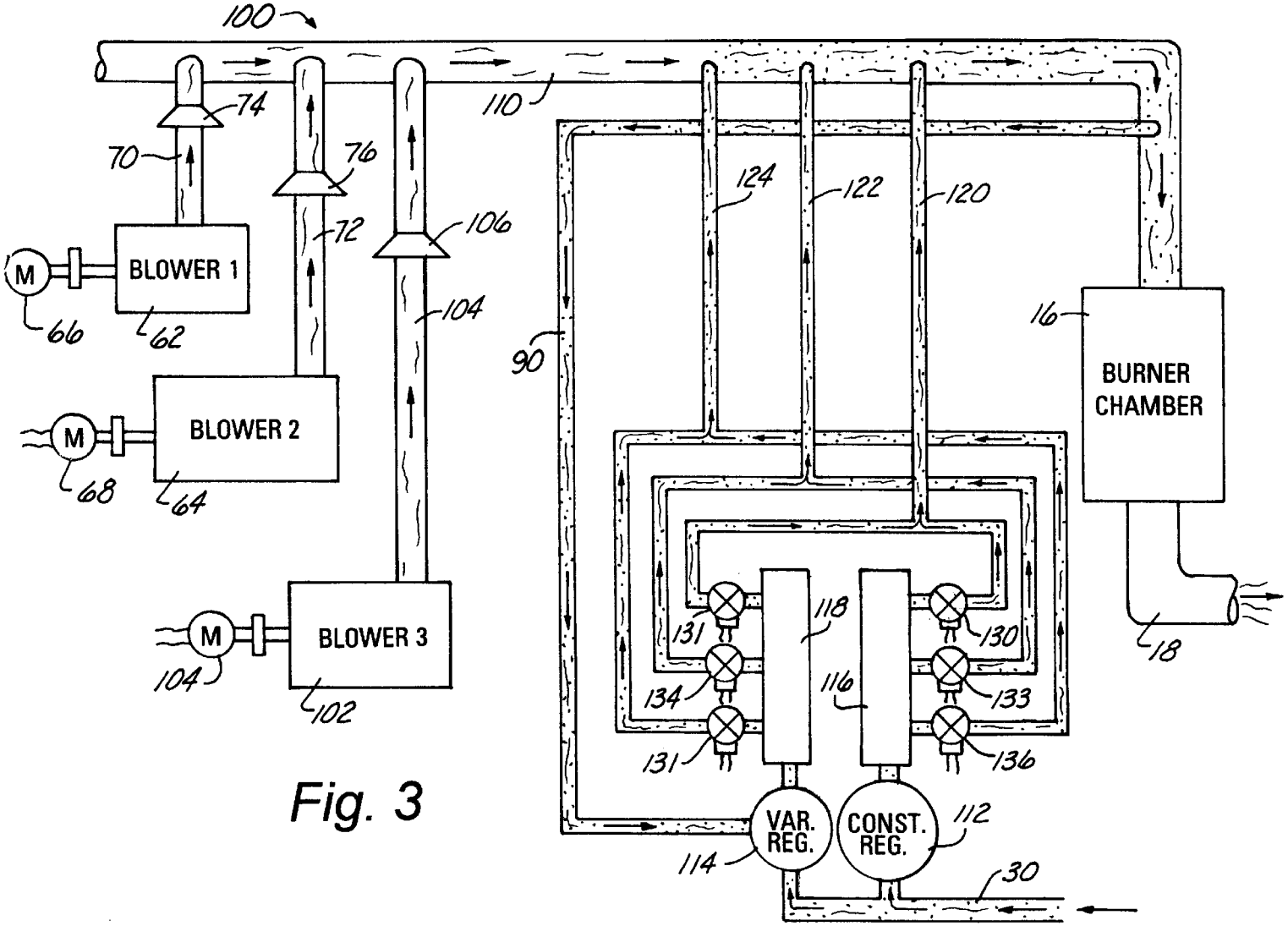
FIG. 3 is a schematic view of a dual regulator direct-fired steam generator built utilizing multiple stages and three blowers.

The present embodiment is shown without manifolds. In this implementation, the orifices are places at output connection of the regulators. Obviously, this implementation could be modified to include manifolds. The use of manifolds, as will be discussed below in reference to FIG. 3, provides several benefits. For one, the use of manifolds eliminates the need for multiple variable pressure gas regulators and multiple constant pressure gas regulators. This is possible since the pressure setting for the regulators does not need to change for the feeding of blowers of different sizes. Additionally, implementation of different orifice, i.e. different sizes, can be used to correct supply fuel for the different size blowers.

Referring now to FIG. 3, a three blower direct-fired steam generator system (100) is shown. This system (100) is similar to the previously discussed system (60) and includes a blower 3 (102). In a preferred embodiment, the third blower is approximately twice the size, i.e. has twice the capacity, as blower 2 (64). Blower 3 (102) is shown with accompanying motor (104). With the three blowers (62, 64 and 102) as shown, the system can operate in seven stages not counting the state when the machine in nonoperationial.

Blower 3 (102) includes a delivery conduit (104) and a check valve (106) which operate in essentially the same manner as discussed above for the other blowers (62 and 64). In this implementation of the present invention, all of the air delivery conduits (70, 72, and 104) utilize a common conduit (110) for ultimately delivering air to the burner chamber (16).

As mentioned above, in this implementation only one constant pressure gas regulator (112) and one variable pressure gas regulator (114) is utilized. Back pressure is delivered to the variable pressure gas regulator (114) via conduit (90). A manifold (116) is connected to the constant pressure gas regulator (112) and is utilized to supply gas to three separate lines corresponding to the three blowers. Similarly, manifold (118) is connected to the variable pressure gas regulator (114) and is utilized to supply gas to three separate lines corresponding to the three blowers. The orifices are inserted into the manifold as described above at each connection of conduit to the manifolds. Different size orifices can be used at each connection.

Each blower (62, 64 and 102) has a corresponding fuel delivery conduit, conduit (120), conduit (122) and conduit (124), respectively. Each conduit receives gas from a pair of openings, one in the manifold (118) connected to the variable pressure gas regulator (114) and one in the manifold (116) connected to the constant pressure gas regulator (112).

The conduit (120) corresponding to blower 1 (62) includes two valves (130 and 131). Valves (130 and 131) are electro-mechanical valves, which are well known in the art, and are opened when blower 1 (62) is operating permitting the delivery of gas into conduit (110) for delivery to the burner chamber (16). This two valve (130 and 131) control is slightly different than the implementation discussed above. From a functional perspective, this implementation is preferred because it prevents pressure from one manifold from seeping into the other manifold when the control valve is closed.

Conduit (122) with corresponding valves (133 and 134), and conduit (124) with corresponding valves (136 and 137), operate in a similar manner to conduit 120 with valves (130 and 131), respectively for blower 2 (64) and blower 3 (102). As in the examples discussed above, the feedback conduit (90) is placed on the burner chamber side (16) of the check valves and the regulators (112 and 114) are supplied with gas via conduit (30).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A boiler apparatus comprising:

a burner chamber for receiving fuel and oxygen in sufficient quantities to support combustion and for receiving liquid water during combustion for conversion of same to steam, said burner chamber including an output for exiting the atmospheric contents of said burner chamber;

a blower system for providing air to said burner chamber, said blower system including at least one blower;

blower conduit means for delivering air from said blower system to said burner chamber;

a fuel system for providing fuel to said burner chamber;

wherein said fuel system includes a constant gas pressure regulator and a variable gas pressure regulator;

fuel conduit means for delivering fuel from said fuel system to said burner chamber; and wherein said variable gas pressure regulator varies with respect to a feedback pressure, said feed back pressure representative of the pressure inside the burner chamber.

2. The boiler apparatus of claim 1 wherein said fuel conduit means is connected to said burner chamber.

3. The boiler apparatus of claim 1 wherein said fuel conduit means is connected to said blower conduit means.

4. The boiler apparatus of claim 1:

wherein said fuel conduit means includes a first manifold connected to said constant gas pressure regulator; and wherein said fuel conduit means includes a second manifold connected to said variable gas pressure regulator.

5. The boiler apparatus of claim 4:

wherein gas fuel enters said first manifold from said constant gas pressure regulator and exits said first manifold through one or more openings in said first manifold;

wherein said fuel conduit means is connected to each of said one or more openings in said first manifold;

wherein said fuel conduit enters said second manifold from said variable gas pressure regulator and exits said second manifold through one or more openings in said second manifold; and wherein said fuel conduit means is connected to each of said one or more openings in said second manifold.

6. The boiler apparatus of claim 5 wherein the size of each of said one or more opening in said first manifold and said one or more openings in said second manifold is determined by an orifice.

7. The boiler apparatus of claim 6 wherein the settings for and selection of said constant gas pressure regulator, said variable gas pressure regulator, and said orifices are selected in order to minimized carbon-monoxide emissions during operations of said boiler apparatus.

8. The boiler apparatus of claim 5 wherein said fuel conduit means includes valve means for selectively permitting and not permitting gas to be delivered to said burner chamber.

9. The boiler apparatus of claim 8:

wherein said blower systems includes a plurality of blowers; and wherein for each blower of said plurality of blowers there exists at least one corresponding pair of openings, a pair of openings comprising one opening in said first manifold and one opening in said second opening.

10. The boiler apparatus of claim 9 wherein each blower of said plurality of blowers can independently and selectively be operated.

11. The boiler apparatus of claim 10:

wherein said valve means comprises a series of valves;

wherein each of said pair of openings is connected to at least one valve of said series of valves, wherein said at least one valve selectively controls whether gas from said pair of openings is delivered to said burner chamber.

12. The boiler apparatus of claim 11:

wherein said at least one valve of said series of valves connected to said each of said pair of openings is selectively controlled to permit gas to be delivered to said burning chamber when said blower corresponding to said pair of opening is operational; and wherein said at least one valve of said series of valve connected to said each of said pair of openings is selectively controlled to prohibit gas from being delivered to said burning chamber when said blower corresponding to said pair of opening is nonoperational.

13. The boiler apparatus of claim 12 wherein said at least one valve of said series of valves connected to said each pair of openings comprises two valves with each valve selectively controlling the flow of gas from each opening.

14. The boiler apparatus of claim 13 wherein said series of valves include electro-mechanical valves.

15. The boiler apparatus of claim 13 wherein said series of valves include both electro-mechanical valve and check valves.

16. The boiler apparatus of claim 13 wherein said plurality of blowers comprise a set of blowers of varying sizes.

17. The boiler apparatus of claim 16 wherein, from smallest to largest, each blower in the set is approximately twice the size of the next smallest blower.

18. The boiler apparatus of claim 17 wherein said plurality of blowers are utilized to implement a multi-stage operational scheme wherein the steps between stages are relatively equal.

* * * * *